US005651398A

United States Patent [19]

Decker et al.

[11] Patent Number: 5,651,398

[45] Date of Patent: Jul. 29, 1997

[54] CHEMICAL SOLUTION FILLING SYSTEM

[75] Inventors: James D. Decker; James L. Copeland, both of Apple Valley, Minn.

[73] Assignee: Ecolab Inc., St. Paul, Minn.

[21] Appl. No.: 624,992

[22] Filed: Mar. 29, 1996

[51] Int. Cl.[6] ..... B65B 1/04

[52] U.S. Cl. ..... 141/18; 141/97; 141/104; 141/367; 141/374; 141/387; 222/133; 137/892

[58] Field of Search ..... 141/2, 18, 97, 141/102, 104, 105, 323, 367, 369, 370, 372, 374, 375, 378, 387; 222/132, 133; 239/318; 137/888, 892

[56] References Cited

U.S. PATENT DOCUMENTS

| | | | |
|---|---|---|---|
| D. 335,566 | 5/1993 | Spriggs et al. | D34/14 |
| 3,003,521 | 10/1961 | Colonna | 239/318 |
| 3,638,392 | 2/1972 | Welker et al. | 141/105 |
| 5,033,649 | 7/1991 | Copeland et al. | 222/132 |
| 5,042,523 | 8/1991 | Robertson et al. | 137/271 |
| 5,255,820 | 10/1993 | Thomas | 222/1 |
| 5,259,557 | 11/1993 | Spriggs et al. | 239/304 |
| 5,344,074 | 9/1994 | Spriggs et al. | 239/10 |
| 5,351,875 | 10/1994 | Rhine et al. | 222/132 |
| 5,597,019 | 1/1997 | Thomas et al. | 141/18 |

*Primary Examiner*—Henry J. Recla
*Assistant Examiner*—Steven O. Douglas
*Attorney, Agent, or Firm*—Merchant, Gould, Smith, Edell, Welter & Schmidt, P.A.

[57] ABSTRACT

A method for dispensing and handling chemical solutions by using a dispensing station. The dispensing station includes a cabinet having a fill compartment and at least one concentrate bottle compartment. The cabinet's top wall has a funnel for supporting a dilution gun. The gun is in fluid communication with a water source and has a removable insert containing an aspirator. The insert's outlet tube fits within the cabinet's funnel. A pickup tube extends from the concentrated chemical solution to the gun. A use container such as a spray bottle is sized and configured to fit within the fill compartment. In the preferred embodiment, the concentrate container has a plurality of grooves which are sized and configured to correspond with a plurality of ribs within the concentrate compartments. Additionally, the concentrate compartment's lower portion forms a track to accommodate a bottom portion of the concentrate container.

19 Claims, 7 Drawing Sheets

CHEMICAL SOLUTION FILLING SYSTEM

FIELD OF THE INVENTION

This invention relates generally to a solution dispensing system, and more particularly to a system for filling spray bottles with a diluted detergent solution.

BACKGROUND OF THE INVENTION

In janitorial settings which require significant amounts of specialized cleaning solutions, the liquid cleaning products are purchased on a concentrated basis, and then are diluted to the proper strength at the site where they will be used. This type of general system is employed by a wide variety of users, e.g., hotels, hospitals, restaurants, etc. Several dispensing systems have been developed for mixing and diluting the concentrated cleaning products.

Many dispensing systems require several separate water lines, each water line corresponding to a different type of cleaning concentrate. With these systems, each water line includes a separate backflow preventer, dosing mechanism, and flow controls. However, dispensing and handling systems have been developed by the Applicant in which only a single water line is used. When only a single water line is employed, costs are minimized because only a single backflow preventer is needed. With the Applicant's systems, each concentrate conduit can be releasably attached to the water line for quick connection and disconnection of different cleaning concentrates. These systems are described and illustrated in U.S. Pat. Nos. 5,033,649; 5,255,820; 5,259,557; and 5,344,074.

Many dispensing stations are not easily portable; they are too large to move to various points of usage. The dispensing stations usually feature at least some of the following components: one or more containers for the concentrated cleaning products, a water supply line to dilute the concentrate, an intermediate-sized storage container for the diluted cleaning product, and a mechanism for dosing concentrate into the storage container. Small-sized spray bottles are filled from the storage container and then taken to the point of usage by the janitorial personnel. The intermediate-sized container is typically three to five gallons in size. This type of a jug is illustrated in U.S. Pat. Nos. 5,033,649 and 5,259,557.

However, the use of these jugs increases the storage requirements for the dispensing system, and makes the system less portable. Also, janitorial personnel sometimes prefer to have a relatively small amount of fresh diluted cleaning solution prepared immediately before use.

The present invention solves these and many other problems associated with currently available dispensing systems.

SUMMARY OF THE INVENTION

The present invention is a method for dispensing and handling liquid solutions by use of a dispensing station. The steps of the method include: connecting a concentrate tube with a dilution gun, the concentrate tube being in fluid communication with concentrated chemical solution which is held in a container positioned in a concentrate compartment; placing a use bottle in a fill compartment of the dispensing station; inserting the gun's outlet tube into a funnel of the dispensing station so that the outlet tube is above the use bottle; and activating the gun means until the use bottle is filled. In the preferred embodiment, different types of concentrate can be dispensed by using a quick connection means on the dilution gun.

Another aspect of the invention is a dispensing system for dispensing diluted chemical solutions. The dispensing system comprises a cabinet including a fill compartment, at least one concentrate bottle compartment, and a top wall having funnel means; a gun means in fluid communication with a water source and having an outlet tube which fits within the funnel means; at least one bottle of concentrated chemical solution which is positioned in the concentrate bottle compartment; at least one concentrate tube extending from the concentrated chemical solution to the gun means; and a use container sized and configured to fit within the fill compartment. In the preferred embodiment, the concentrate container has a plurality of grooves which are sized and configured to correspond with a plurality of ribs within the concentrate compartments. Additionally, the concentrate compartment's lower portion forms a track to accommodate a bottom portion of the concentrate container.

A primary advantage of the present invention is that it is simple, safe and easy to use. When a small container such as a spray bottle must be filled, the gun is positioned within the funnel assembly. In the preferred embodiment, the user simply presses a lever on the dilution gun, which activates a valve in the gun and allows the spray bottle to be filled. The spray bottle is surrounded by side walls and a splash guard during the filling operation, so that any splashing or splattering of the cleaning chemicals is safely contained. The invention's closed pickup tubing and the self-containment of each pickup tube's aspirator also prevent exposure to the concentrated chemicals.

When a large container such as a mop bucket must be filled, the gun is removed from the dispensing station's funnel and is positioned within the mop bucket. The filling of the container is a one-handed operation, because the user simply depresses the gun's water activation lever in order to initiate water flow and dispense the use solution. In contrast, prior art systems are typically two-handed operations, with one hand on the water control device and the other hand controlling the output hose.

Another advantageous feature of the present invention is that it minimizes space requirements. In the preferred embodiment, the system can be mounted on a wall, thus freeing up limited floor space in the janitorial closet. Because large jugs of diluted cleaning products are not necessary, space requirements are further minimized.

Another advantage of the present invention is that it results in cost savings for the user. Because the system is simple in design, its cost is lower than conventional dispensers. The dispensing system requires only a single water line and a single backflow preventer, which further reduces the cost of installation. The present invention operates on water power alone, and does not require electrical connections. The various fittings, tubes, and valves are readily accessible and can be repaired easily by any necessary tightening, repair or replacement measures. The simplicity of the present invention makes it low in cost and affordable for even small housekeeping and food service operations.

The present invention also provides considerable flexibility by allowing the user to employ different types of cleaning products. In the preferred embodiment, there are compartments for up to four types of concentrated chemical solutions. The various components of the dispensing system are color-coded to correspond to the particular cleaning product being utilized. Preferably, there are appropriate labels on the concentrate containers, which identify the name of the particular product being dispensed. This minimizes the chance of contamination and minimizes the likelihood that a particular cleaning product will be used at an improper dilution ratio. Maintaining the proper dilution ratio also results in cost savings for the user, because waste of the cleaning products is eliminated and the effectiveness of the cleaning product is maximized.

For a better understanding of the invention, and of the advantage obtained by its use, reference should be made to the drawings and accompanying descriptive matter, in which there is illustrated and described a preferred embodiment of the invention.

BRIEF DESCRIPTION OF THE DRAWINGS

In the Drawings, which form part of the instant specification and are to be read therewith, an optimum embodiment of the invention is shown, and in the various views, like numerals are employed to indicate like parts.

DETAILED DESCRIPTION OF THE PREFERRED EMBODIMENT

Figure 1:
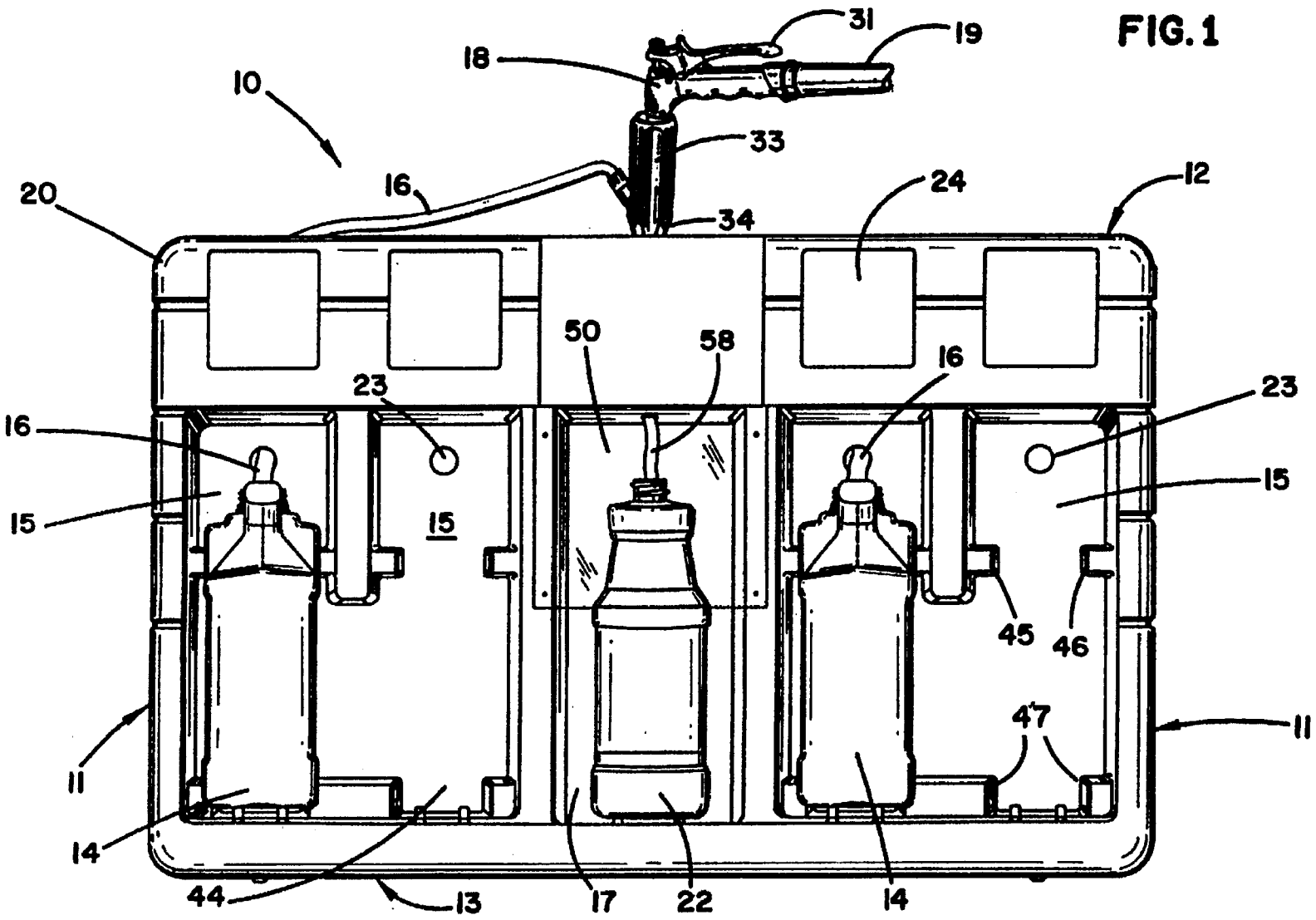
FIG. 1 is a front elevational view of the dispensing system.

FIG. 1 illustrates the dispensing station 10 of the present invention. The dispensing station 10 includes a cabinet 20 which has opposite side walls 11; top and bottom walls 12, 13; and a rear wall 21 (shown in FIGS. 2 and 3). In the preferred embodiment, the cabinet 20 is made from a suitable plastic material.

The cabinet 20 has a plurality of compartments, each compartment being open and accessible from the front side of the dispensing station 10. In the preferred embodiment, there is a central compartment 17, surrounded on each side by a plurality of concentrate compartments 15.

The central compartment 17, or fill compartment, is sized and configured to accommodate a standard-sized spray bottle 22 of the type used in cleaning operations. The spray bottle 22 has a hand-operated pump and nozzle assembly (not shown) for pumping the solution out of the bottle and onto the surface to be cleaned. This pump assembly is removed before the filling process. The spray bottle 22 may be approximately 16–32 ounces in size. When the spray bottle is placed in the fill compartment 17 as shown in FIG. 1, it is surrounded on three sides by the walls of the compartment 17. At the front of the central fill compartment 17 is a splash shield 50. The splash shield 50 prevents the user from unwanted exposure to the chemical solutions. The splash shield 50 is preferably made of clear plate glass, PET or Plexiglas™.

The splash shield 50 is suitably attached to the top of the fill compartment 17. The splash shield 50 may be releasably attached or hinged to the cabinet 20. Alternatively, the splash shield 50 may be permanently attached, such that the container 22 can be positioned within the fill station 17 by simply inserting it beneath the splash shield 50. During filling of the diluted cleaning chemical, the use bottle 22 is in position in the compartment 17. The compartment 17 is also a convenient place for holding a spray bottle 22 that is not being used.

The concentrate compartments 15 are approximately the same height and width as the fill compartment 17. Preferably, the concentrate containers are approximately two liters in size. Although four concentrate compartments 15 are illustrated, it is to be understood that the dispensing station could have one or more concentrate compartments 15. Each concentrate compartment 15 is sized and configured to accommodate a concentrate container 14. Preferably, the bottom end of each concentrate compartment 15 has a track 44 for accommodating a concentrate container 14, the track 44 being defined by a pair of parallel rails 47. Each concentrate container 14 contains a concentrated liquid cleaning solution or other type of concentrated chemical solution. The back wall 21 of each concentrate compartment 15 has an aperture 23.

In the preferred embodiment, the cabinet 20 is mounted upon a wall (not shown). Suitable apertures 26, 77 (shown in FIG. 2 and 3) in the rear wall 21 and top wall 12 are provided for the purpose of accommodating suitable wall fasteners. Alternatively, the dispensing station cabinet 20 could be positioned upon a shelf, rack or cart.

Each concentrate bottle 14 has a dip tube 71 extending to the bottom of the bottle 14. The lower end of the dip tube 71 extends into the liquid concentrate inside the bottle 14. Preferably, the lower end of the dip tube 71 extends to the lowest portion 75 of the bottle 14, shown in FIG. 4. The dip tube 71 inside the concentrate container 14 may have a foot valve (not shown) to prevent backflow of the liquid concentrate into the concentrate container 14.

Figure 3:
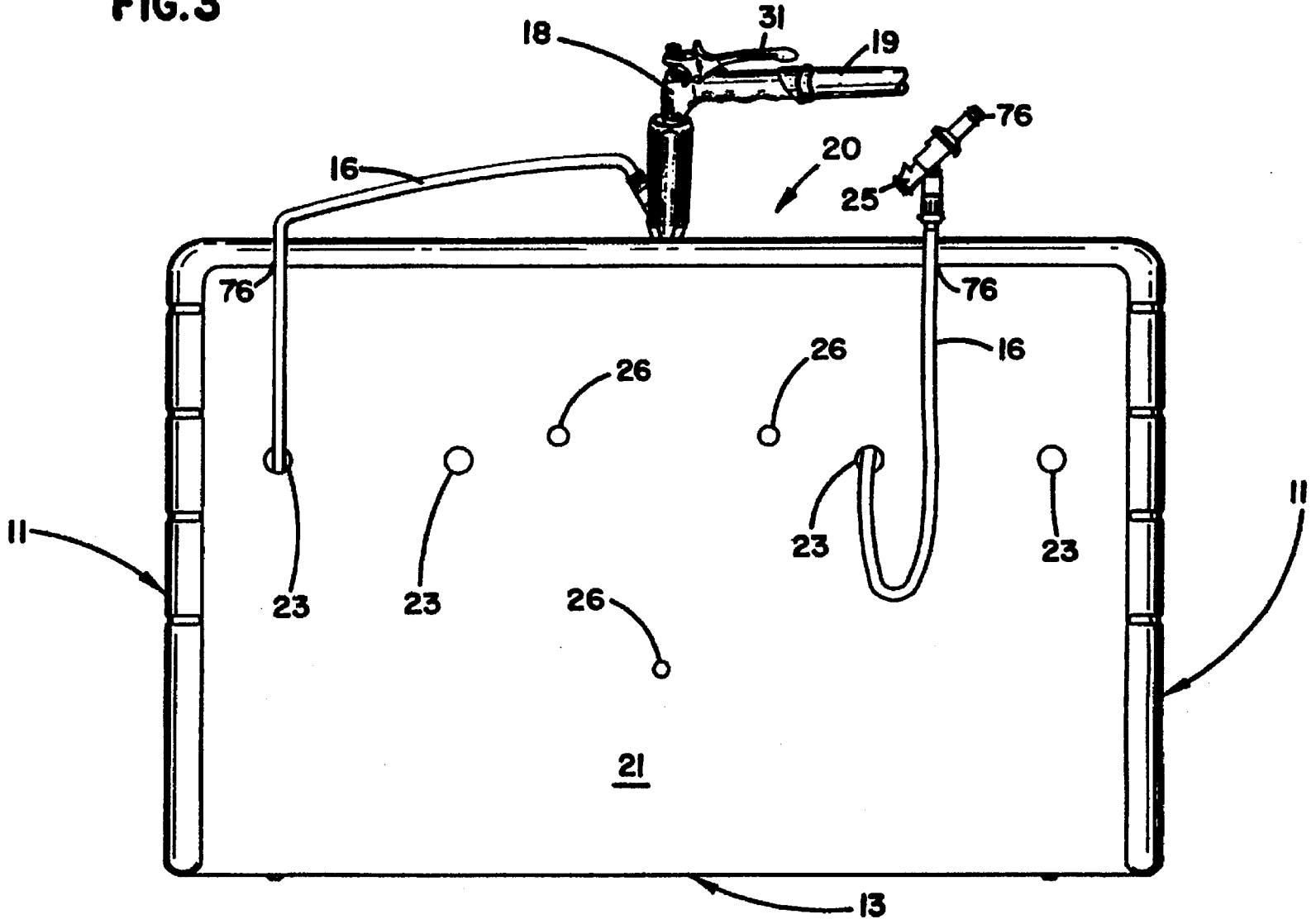
FIG. 3 is a rear elevational view of the dispensing system.

A plurality of pickup tubes 16 transport the concentrate solutions from the containers 14 to the dilution gun 18. Each dip tube 71 is in fluid communication with a pickup tube 16. Each pickup tube 16 extends from the neck 37 of the bottle and then through the corresponding apertures 23, 76 in the back and top walls of the cabinet 20, respectively. In FIG. 3, two pickup tubes 16 are illustrated.

Figure 6:
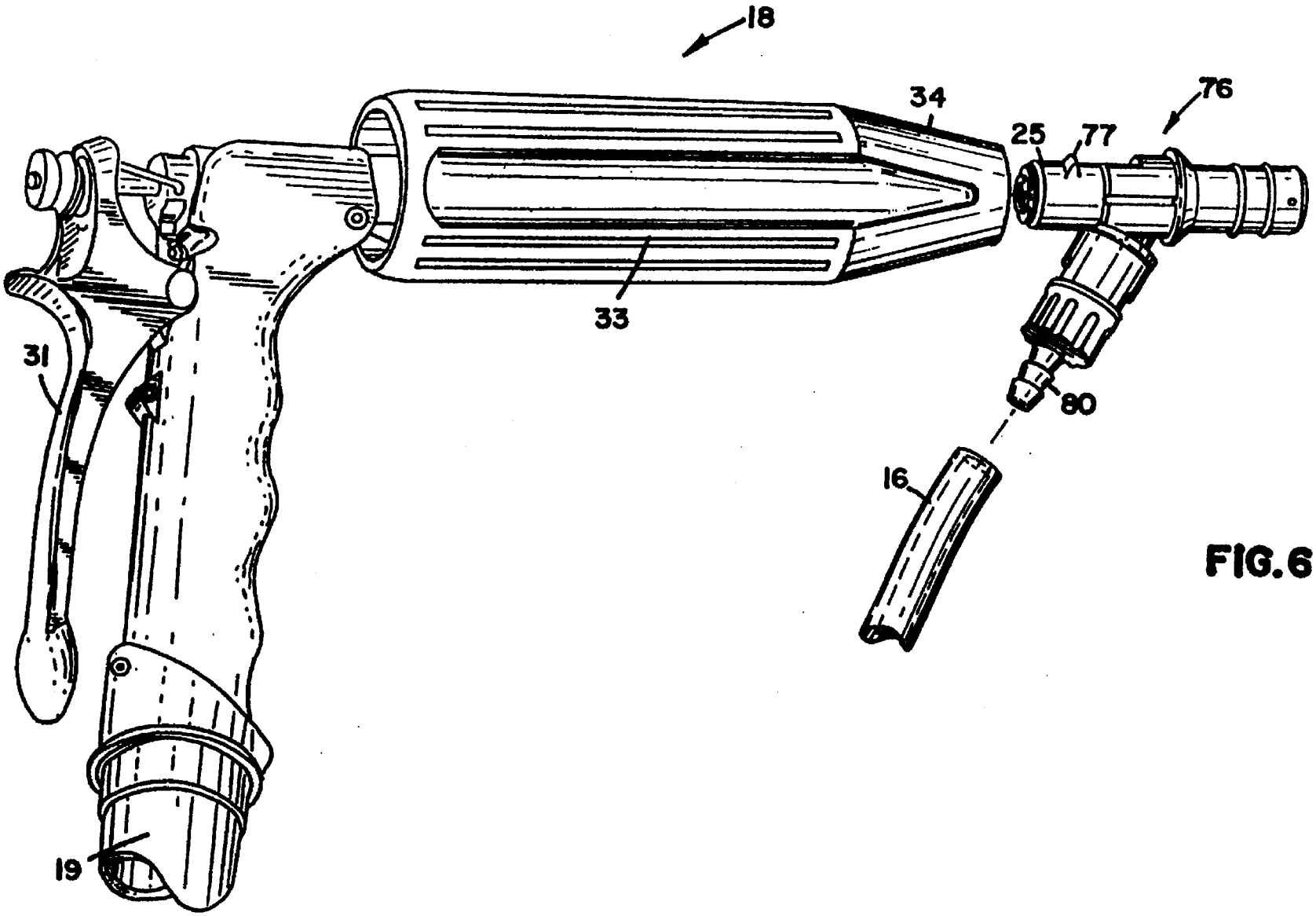
FIG. 6 is a perspective, exploded view of the dilution gun used with the dispensing system.
Figure 8:
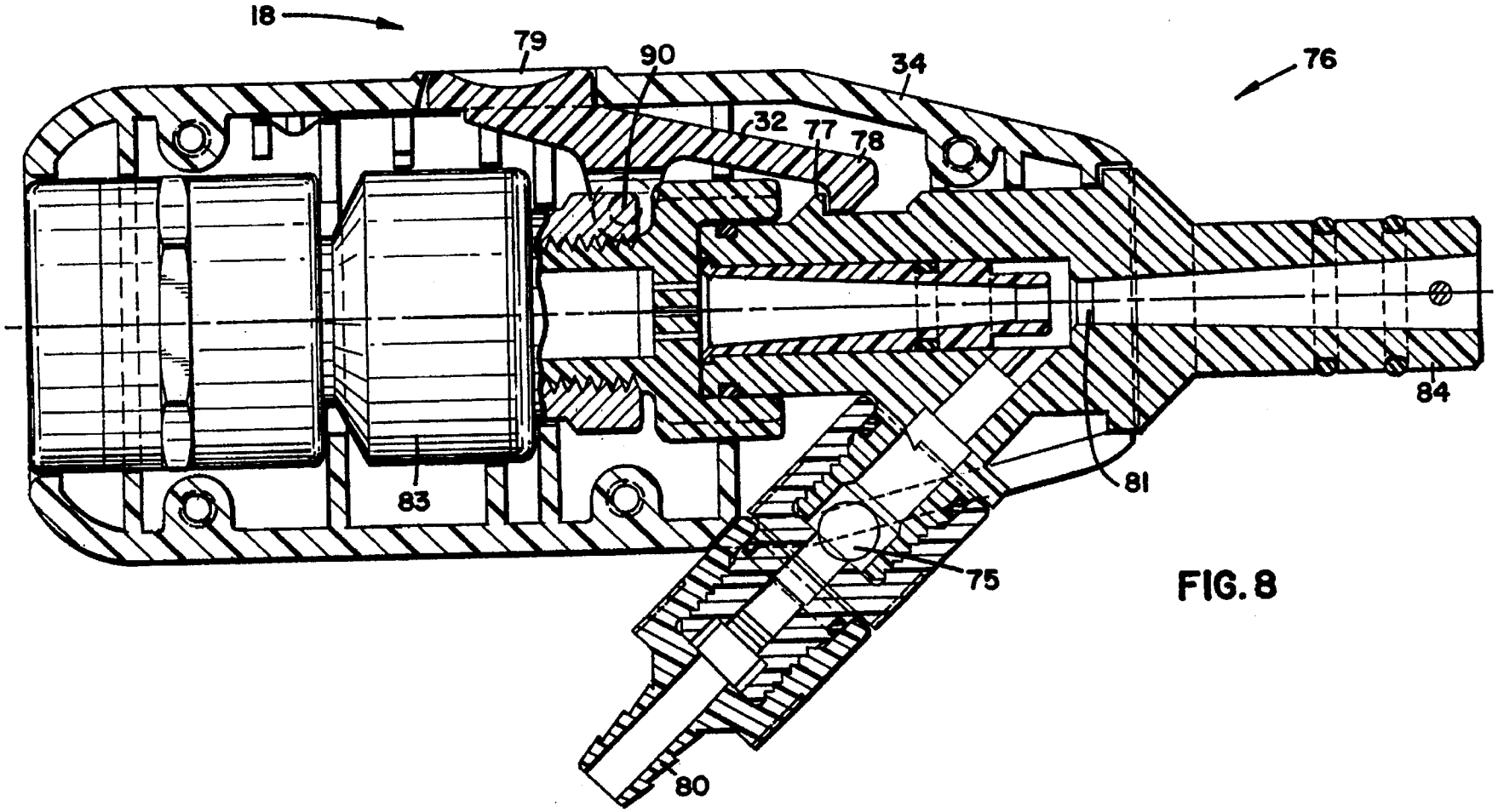
FIG. 8 is a side elevational, cross sectional view of the dilution gun shown in FIG. 6.

At the upper end of the pickup tube 16 is an insert 76 having a quick-connect assembly 25. Within the insert 76 is an aspirator 81. Accordingly, each pickup tube 16 has its own aspirator 81. The quick-connector 25 releasably attaches to a quick-connect assembly 32 in the gun 18. As shown in FIGS. 6 and 8, one end of the insert 76 is insertable within the frustoconical portion 34 of the gun's barrel. The insert 76 has an exterior detent 77. Inside the dilution gun 18 is a movable locking arm 78 which is engageable with the detent 77 to lock the insert 76 in engagement with the dilution gun 18. The locking arm 78 is rotatable about a pin 90. The insert 76 can be removed form the dilution gun 18 by depression of a pushbutton 79. The pushbutton 79 rotates the locking arm 78 out of engagement from the detent 77, so that the insert 76 can be removed.

The upper end of the concentrate tube 16 is preferably interconnected to the insert 76 by means of a barbed fitting 80. In the preferred embodiment, the pickup tube 16 is relatively permanently attached to the insert 76, so that the proper insert 76 does not come detached easily from the pickup tube 16.

The gun means 18 has an outlet tube 84. When the gun 18 is in position for filling a spray bottle, the outlet tube 84 is in a substantially vertical position. The insert 76 preferably has an integrated valve 75. The valve 75 automatically opens when the connectors 25, 32 are engaged. The valve 75 minimizes any spillage of solution upon connection or disconnection of the insert 76 from the gun 18.

The dilution gun 18 is interconnected to a diluent supply conduit 19, which supplies water or any other type of diluent. The water supply line 19 is interconnected to a suitable faucet or quick-connect fitting. The gun means 18 contains a valve and a backflow preventer 83, such as a siphon break system. Various other flow control devices may also be provided. These types of devices (not shown) are governed by the requirements of local plumbing codes. Within the gun 18, the water is mixed with the cleaning concentrate, after which the diluted product is dispensed into the spray bottle 22.

Preferably, a valve is contained within a handle portion of the gun 18. This valve is opened by depressing the gun's lever 31. The lever 31 is spring-loaded, so that the valve is biased in a normally closed position. On the barrel of the gun 18, there is a quick-connect fitting 32, which is sized and configured to correspond with the quick-connect device 25 at the end of each pickup tube 16. This allows for the quick connection and disconnection of each pickup tube 16 from the gun 18.

The vacuum created by the water line 19 is utilized to withdraw the proper proportion of concentrated cleaning solution from the container 16 and through the aspirator. In this manner, the water and concentrate enter the gun 19 and spray bottle 22 simultaneously. The spray bottle 22, or other type of use container, is filled with the diluted cleaning product and is ready for use. Various other constructions may be employed for controlling the water flow and for withdrawing the concentrated solution from the container 14, such as an electrical or mechanical pump. Alternatively, the gun 18 may have removable proportioning means, such as the type described in U.S. Pat. No. 5,344,074.

In the preferred embodiment, the gun housing has a cylindrical portion 33 and a frustoconical portion 34. The outlet end of the frustoconical portion 34 terminates in the insert 76, which has a cylindrical outlet tube 84, as shown in FIG. 8. A longer outlet tube (not shown) can be slip fit onto the outlet tube 84 to facilitate the filling of mop buckets, auto scrubbers, or other large containers.

Examples of the concentrated cleaning solution utilized with the dispensing station are: multi-purpose cleaners, e.g., for walls, windows, tile, and hard surfaces; germicidal detergents for disinfecting and sanitizing; floor care products; and specialty products for special cleaning needs. However, it is to be understood that the present invention is not to be limited for use only with cleaning products, but can be utilized to store and dispense any type of solution.

The blend ratio, or proportion of chemical to water, is set by flow metering means, such as interchangeable metering tips (not shown). The metering tip is insertable into the pickup tube 16, with the orifice size of the metering tip allowing for different flow rates of concentrate. The highest flow rate is achieved when no metering tip at all is present in the pickup tube 16. Different dilution ratios are sometimes needed for different applications, e.g., one cleaning application might require a one percent cleaning solution, whereas another cleaning application may require a ten percent solution of the same product. In these situations, two of the concentrate containers 14 may contain the same kind of cleaning concentrate, or two of the pickup tubes 16 (each having a different-sized metering tip) could extend from a single concentrate container. An alternative method for controlling the blend ratio of the concentrate would be an adjustable metering screw.

Preferably, the walls of the concentrate containers 14 and spray bottle 22 are translucent or clear, so that the user can see how much solution is in each container 14. Each pickup tube 16 is also preferably translucent or clear, so that the user can verify when it is filled with concentrate, and so that the user can see the metering tip within the tube 16.

Another feature of the dispensing station is the use of identification means on the corresponding components of the system 10. The front face of the cabinet 20 has a plurality of flat surfaces 24, each surface 24 being suitable for application of an adhesive label. In the preferred embodiment, the label on the surface 24 corresponds with a label (not shown) on the corresponding bottle 14 beneath the label area 24. The spray bottle 22 and the pickup tube 16 may also be appropriately color-coded or labeled. In this manner, the janitorial personnel are aided in placing the correct bottle 14 in the correct compartment 15.

Figure 2:
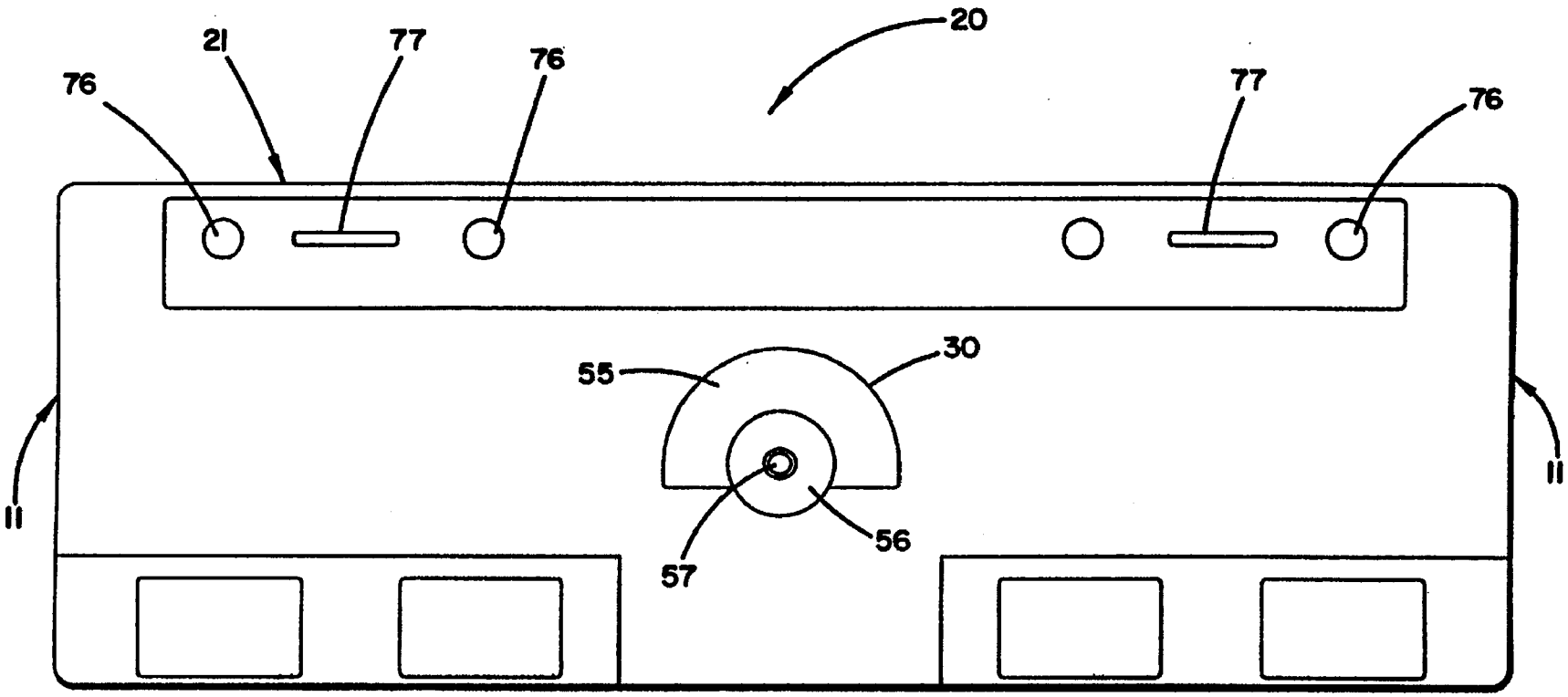
FIG. 2 is a top plan view of the dispensing system's cabinet.

As shown in FIG. 2, the cabinet 20 has a funnel assembly 30. In the preferred embodiment, the funnel 30 serves as a holder for the gun 18 when it is not being used to fill large containers. The funnel 30 has a semi-circular recessed well 55, which partially surrounds a central, circular fill port 56. The fill port 56 is recessed deeper than the well 55. At the center of the fill port 56 is an aperture 57 which extends through the top wall 12 of the cabinet 20. At the lower end of the aperture 57, there is a flexible dispensing tube 58 which extends downwardly into the fill compartment 17. When the use container 22 is to be filled, the dispensing tube 58 is inserted in the neck of the bottle 22.

If a relatively large amount of cleaning product must be dispensed, the cleaning solution can be dispensed directly into a mop bucket or other type of large container by removing the gun 18 from the funnel 30 and positioning the gun 18 so that the cleaning solution is dispensed directly into the mop bucket or other large container. In the preferred embodiment, the diluted cleaning solution is dispensed from the gun 18 at a rate of approximately two gallons per minute.

Figure 4:
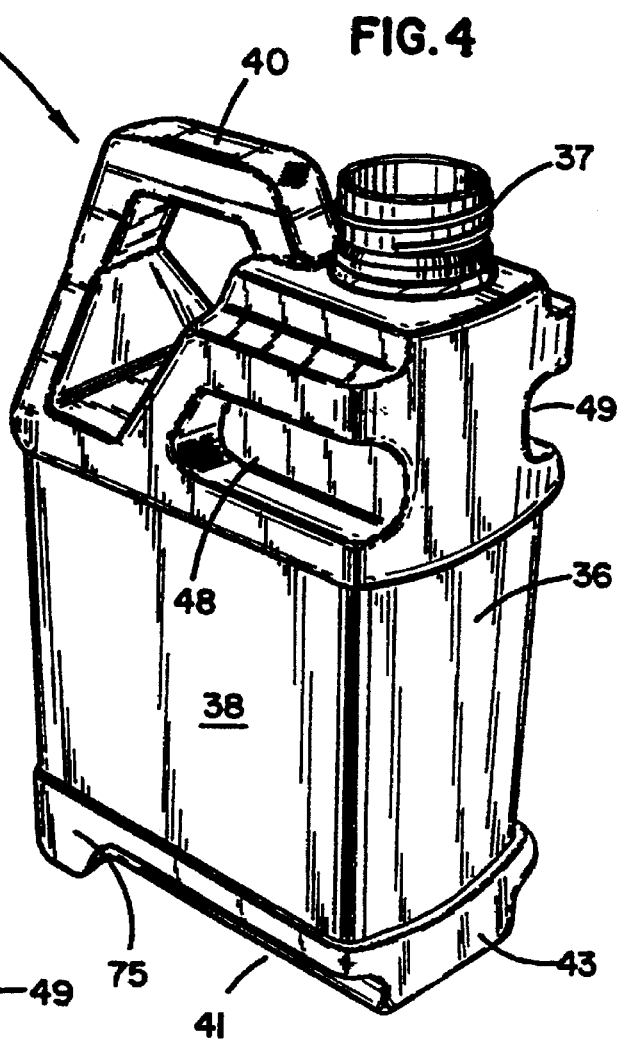
FIG. 4 is a perspective view of the concentrate bottle used with the dispensing system.
Figure 5:
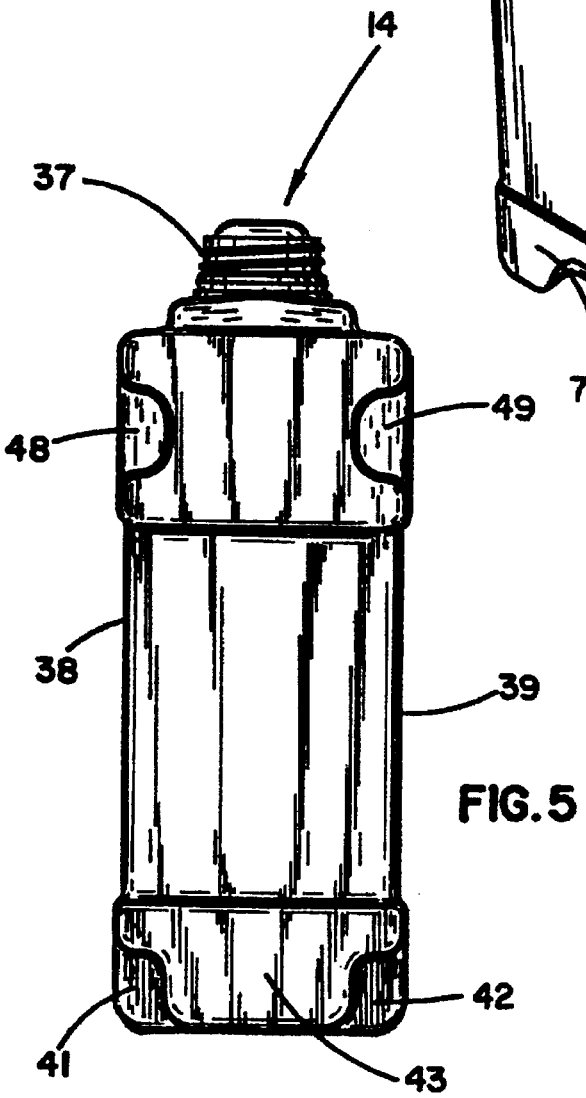
FIG. 5 is a side elevational view of the container illustrated in FIG. 4.

FIGS. 4 and 5 illustrate the concentrate solution container 14. The container 14 has a back wall 36, which extends vertically beneath the container's neck 37. The container 14 also has opposite side walls, 38, 39. The upper end of the container 14 opposite the neck 37 has a handle 40. At the bottom end of the concentrate bottle 14 are a pair of longitudinal notches 41, 42, between which is a central bottom portion 43. As shown in FIG. 1, the bottom portion 43 is slidably engageable with the track 44 in each concentrate compartment 15.

Each concentrate compartment 15 has a pair of ribs 45, 46. In the preferred embodiment illustrated in FIG. 1, the ribs 45, 46 are oppositely disposed on the side walls of the concentrate compartment 15. Proximate the upper portion of the concentrate container 14 are a pair of grooves 48, 49. The grooves 48, 49 are sized and configured so that the rails 45, 46 of the compartment 15 are slidably engageable with the grooves 48, 49 of the concentrate bottle 14. The size and position of the grooves 48, 49, and corresponding ribs 45, 46, and the size and position of the track 44 and corresponding bottom portion 43, can be varied. For example, if a certain compartment 15 were to be dedicated to accommodate only a certain type of concentrate, then the bottle 14 and corresponding compartment 15 could be appropriately "keyed" to fit each other. In the embodiment of the dispensing station 10 illustrated in FIG. 1, each of the concentrate compartments 15 has the same groove and track design.

However, it is within the scope of the present invention to have different groove and track designs for different concentrate compartments 15, so as to dedicate each concentrate compartment 15 to a particular type of concentrate.

Figure 7:
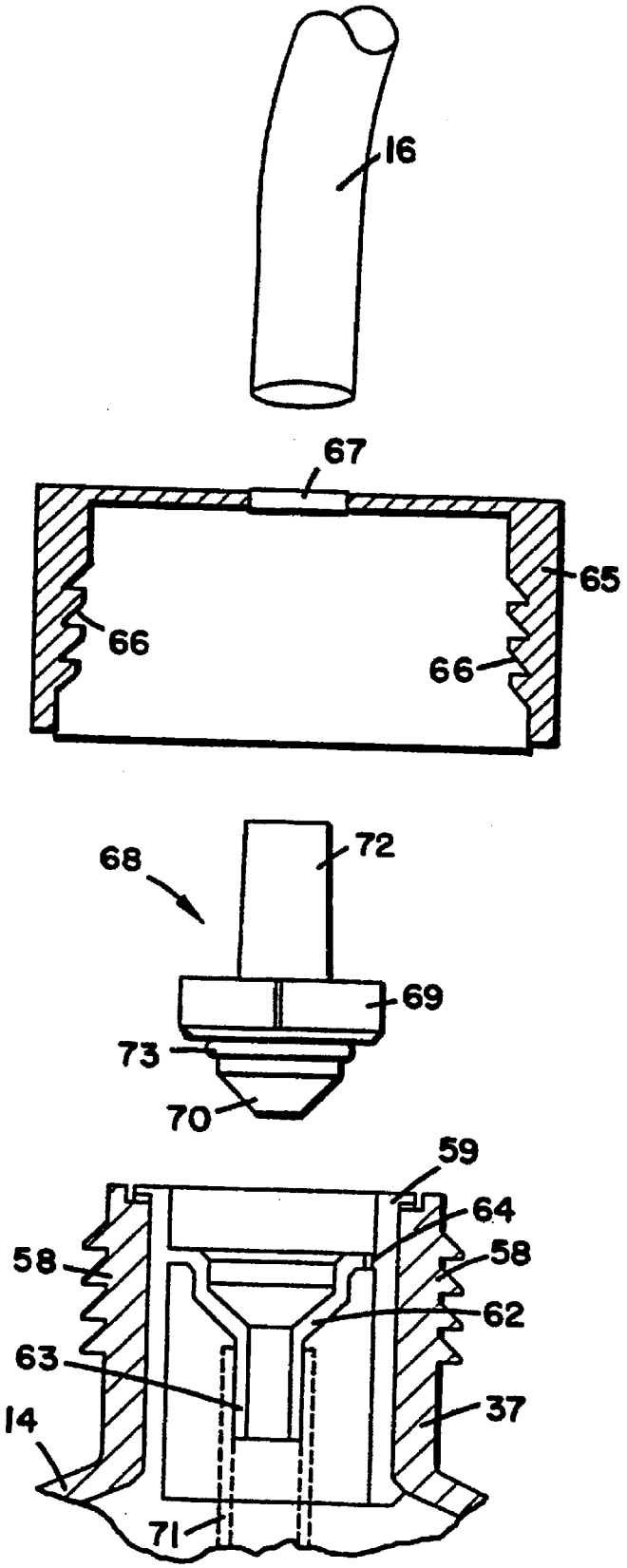
FIG. 7 is an exploded, cross-sectional view of the cap structure of the container illustrated in FIGS. 4 and 5.

FIG. 7 is an exploded, cross-sectional view of the cap structure of the concentrate container 14. The neck 37 of the concentrate container has threads 58. Inside the neck 37 is a bottle fitment 59. The fitment has a cylindrical or frustoconical portion 62, which terminates in a tube connector 63. A dip tube 71 is attached to the tube connector 63 and extends to the bottom of the concentrate container 14. The fitment 59 has a vent hole 64. Before the two halves of the bottle mold are adhered together, the dip tube 71 has been attached to the tube connector 63. During manufacture of the bottle 14, the fitment 59 is adhered inside the neck 37 of the bottle 14.

The concentrate container's cap 65 has a cap fitment 68. The cap 65 has threads 66 which cooperate with the threads 58 on the neck 37. The cap 65 has a central aperture 67 through which a connector 72 extends. The connector 72 may be barbed. Preferably, the pickup tube 16 extends over the connector 72 for a tight fit. The connector 72 may have an annular flange (not shown) for maintaining the cap fitment 68 into place on the cap 65 with a snap fit. The cap fitment 68 has a circular flange 69, below which is a male portion 70 which is sized and configured to fit within the hollow portion 62 of the bottle fitment 59. The male portion 70 of the cap fitment 68 has an O-ring 73 for preventing leakage of the concentrate solution.

In operation of the dispensing system, the concentrate containers 14 and spray bottle 22 are positioned within the appropriate compartments 17, 15 of the cabinet 20. The lower end of the appropriate pickup tube 16 is attached to the cap assembly's connector 72 on the concentrate container 14. The upper end of the pickup tube 16 is attached to the dilution gun 18 via the pickup tube's insert 76. The water conduit 19 is attached to the dilution gun 18 and to the water supply, and water flow is initiated by depression of the lever 31. The diluted chemical solution flows from the gun 18 into the use container 22. When the bottle 22 has been filled to the desired level, the dilution gun's lever 31 is released and the pickup tube 16 may be disconnected from the dilution gun 18. The use container 22 may then be moved to the point of use.

The above specification provides a complete description of the use and construction of the invention. Since many embodiments of the invention can be made without departing from the spirit and scope of the invention, the invention resides in the claims hereinafter appended.

We claim:

1. A method for dispensing and handling chemical solutions by means of a dispensing station, said dispensing station having a fill compartment, a concentrate compartment and a funnel, the method comprising the steps of:

a) connecting a first concentrate tube with a gun means in fluid communication with a water source, said gun means being associated with an outlet tube, said first concentrate tube having a dilution ratio and being in fluid communication with a concentrated chemical solution in a first container and being in fluid communication with an aspirator, said first container being positioned in said concentrate compartment;

b) placing a first use bottle in said fill compartment of said dispensing station, said fill compartment including side walls and a splash guard;

c) inserting said outlet tube in said funnel of said dispensing station so that said outlet tube is substantially vertical and above said first use bottle;

d) activating said gun means until said first use bottle is filled; and e) attaching a pump assembly upon said first use bottle and transporting said bottle to a point of use.

2. The method of claim 1, wherein said gun activation step comprises depressing a lever on said gun means.

3. The method of claim 1, further comprising the steps of:

a) removing said first concentrate tube from said gun means;

b) connecting a second concentrate tube with said gun means;

c) placing a second use bottle in said fill compartment of said dispensing station; and d) activating said gun means until said second use bottle is filled.

4. The method of claim 3, wherein said second concentrate tube is in fluid communication with said first container of concentrated chemical solution and said second concentrate tube features a different dilution ratio than said dilution ratio of said first concentrate tube.

5. The method of claim 3, wherein said second concentrate tube is in fluid communication with a concentrated chemical solution in a second container.

6. The method of claim 3, further comprising the step of placing said first container in said concentrate compartment, wherein said first container and said concentrate compartment have corresponding ribs and grooves.

7. The method of claim 1, further comprising the steps of:

a) removing said gun means from said funnel and placing said outlet tube proximate a large container; and b) activating said gun means until said large container is filled.

8. The method of claim 1, wherein said chemical solution is a cleaning solution.

9. A dispensing system for dispensing a diluted chemical solution, comprising:

a) a cabinet including a fill compartment, at least one concentrate bottle compartment, and a top wall having funnel means, said funnel means being positioned above said fill compartment;

b) a gun means in fluid communication with a water source, said gun means being associated with an outlet tube sized and configured to fit within said funnel means in a substantially vertical position;

c) at least one bottle containing a concentrated chemical solution, said bottle being positioned in said concentrate bottle compartment, said bottle having a handle;

d) at least one concentrate tube having a first end and an opposite second end, said first end being interconnected to said bottle and in fluid communication with the concentrated chemical solution, said second end being interconnected to an insert means for attachment of said concentrate tube to said gun means; and e) a use container sized and configured to fit within said fill compartment.

10. The dispensing system of claim 9, wherein said concentrate compartment has a plurality of ribs.

11. The dispensing system of claim 10, wherein said concentrate bottle has a plurality of grooves sized and configured such that said ribs are slidably engageable with said grooves.

12. The dispensing system of claim 9, wherein said concentrate compartment includes a top end and a bottom end, said bottom end having a pair of parallel rails defining a track.

13. The dispensing system of claim 12, wherein said concentrate bottle has a notched bottom sized and configured such that said bottom is slidably engageable in said track.

14. The dispensing system of claim 9, including four concentrate bottle compartments and four bottles of concentrated chemical solution, each bottle having a concentrate tube in fluid communication with the concentrated solution in said bottle.

15. The dispensing system of claim 9, wherein at least one concentrated chemical solution tube includes a means for controlling a dilution ratio of the concentrated chemical solution in water.

16. The dispensing system of claim 9, wherein said insert means includes an aspirator means.

17. The dispensing system of claim 16, wherein said insert means and said gun means include cooperating quick connect means.

18. The dispensing system of claim 16, wherein said aspirator means is attached to said concentrate tube by a barbed fitting.

19. A dispensing station for dispensing a diluted chemical solution, comprising:

a) a cabinet including a fill compartment, at least one concentrate bottle compartment and a top wall having funnel means, said concentrate bottle compartments having a plurality of grooves;

b) a gun means in fluid communication with a water source, said gun including a gun quick connect means;

c) at least one bottle of concentrated chemical solution, each bottle having a plurality of ribs which are sized and configured to be engageable with said grooves, each bottle being positioned in a concentrate bottle compartment, the concentrated chemical solution in each bottle being in fluid communication with a concentrate tube having a first end and second end, said first end being interconnected to said bottle and in fluid communication with said concentrated chemical solution;

d) an insert means including an insert quick connect means engageable with said gun quick connect means, said insert means being interconnected to said second end of said concentrate tube and including an aspirator means, said insert including an outlet tube, at least a portion of said outlet tube being sized and configured to fit within at least a portion of said funnel means; and e) a use container sized and configured to fit within said fill compartment.

* * * * *